United States Patent [19]

Cowan

[11] Patent Number: 4,723,892

[45] Date of Patent: Feb. 9, 1988

[54] CONSTANT POWER VARIABLE VOLUME PUMP

[76] Inventor: Philip L. Cowan, 901 Ashland, Houston, Tex. 77008

[21] Appl. No.: 28,108

[22] Filed: Mar. 19, 1987

[51] Int. Cl.[4] ..... F04B 1/26

[52] U.S. Cl. ..... 417/222; 92/131

[58] Field of Search ..... 92/131, 135; 417/222, 417/218

[56] References Cited

U.S. PATENT DOCUMENTS

| | | | |
|---|---|---|---|
| 3,301,189 | 1/1967 | Kling | 417/568 |
| 3,489,094 | 1/1970 | Vaughan et al. | 417/222 |

FOREIGN PATENT DOCUMENTS

| | | | |
|---|---|---|---|
| 115838 | 3/1983 | Japan | 417/222 |
| 994264 | 6/1965 | United Kingdom | 417/218 |
| 1397391 | 1/1975 | United Kingdom | 417/222 |

*Primary Examiner*—William L. Freeh

*Attorney, Agent, or Firm*—Gunn, Lee & Jackson

[57] ABSTRACT

A pump control module is provided which may form an integral part of a variable volume pump or which may take the form of a pump attachment and which is operative to continually vary the volumetric output in inverse proportion to the operating pressure at the pump discharge so as to utilize a high percentage of the available horsepower at maximum output over a portion of the operating range of the pump.

15 Claims, 8 Drawing Figures

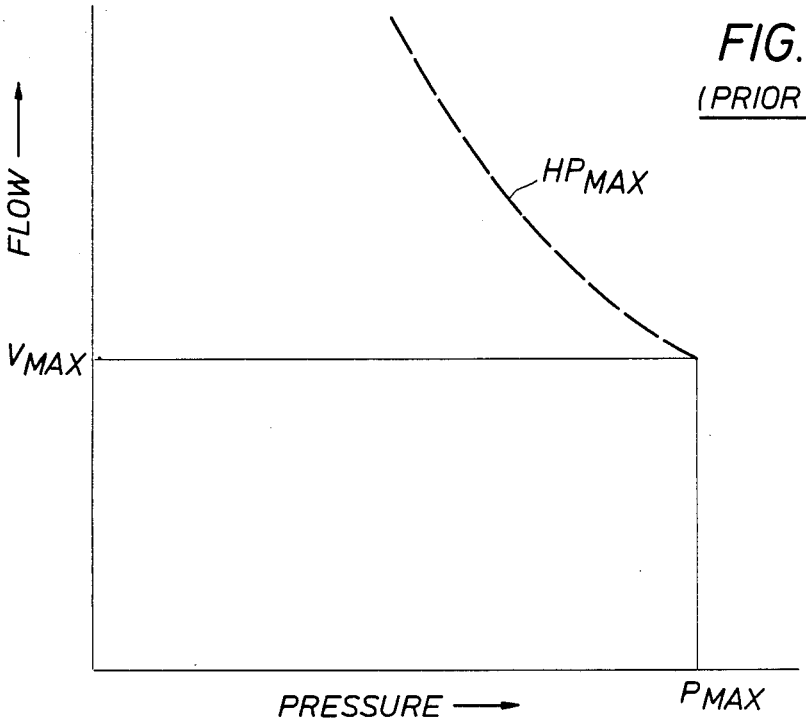
FIG. 3
(PRIOR ART)
FIG. 4
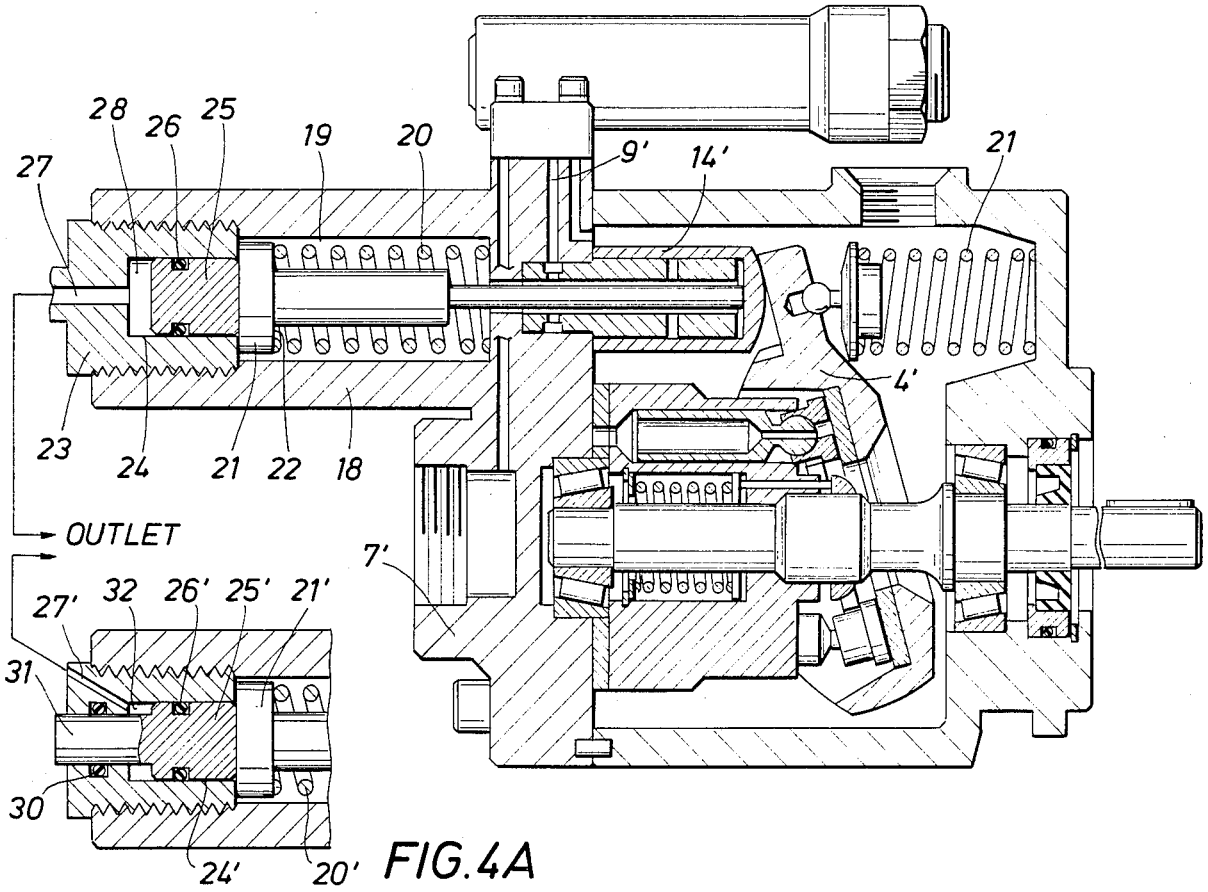
FIG. 4A

CONSTANT POWER VARIABLE VOLUME PUMP

FIELD OF THE INVENTION

This invention relates to an improved hydraulic pump control to provide a simple, low cost method of inversely varying the maximum fluid volume output with the output pressure of a pressure compensated hydraulic pump over a portion of the operating range. Such a pump could find applications for example in portable airless paint pumps where it would be highly desirable to continually vary the maximum operating speed in inverse proportion to the operating pressure so as to utilize a high percentage of the available horsepower over a portion of the operating range.

BACKGROUND OF THE INVENTION

Controls for hydraulic pumps to vary the maximum flow with pressure are generally complex and because of physical space limitations are available only on larger pumps. In portable airless painting equipment the pumps are generally small and thus it is common practice to use a simple pressure compensated pump. It is then necessary to build different machines for high volume/low pressure and for low volume/high pressure applications. A hydraulic pump which would automatically and continuously vary the maximum flow in inverse proportion to the maximum pressure would allow the use of one machine to cover the full range of outputs from low flow/high pressure to high flow/low pressure without overloading the power source and at the same time to utilize a high percentage of the maximum available power over the full range. The subject invention covers a simple and inexpensive method of accomplishing this type of control in a pressure compensated hydraulic pump.

The pressure compensated hydraulic piston pump is widely used in industry as a means of driving a wide range of hydraulic devices. The pressure compensated pump delivers a fixed maximum volume of fluid at pressures below the design level and then an abrupt cutoff of the flow as the design pressure level is reached. Such pumps are usually equipped with a variable pressure control which allows the cutoff pressure to be easily adjusted. They can also be equipped with a volumetric control, usually in the form of a hand wheel, a lever or an adjusting screw. The volumetric control allows the maximum displacement of the pump to be varied independently of the pressure control.

One such type of pump is shown in FIG. 1 This pump is of the axial piston type and is representative of the prior art.

The operation of the pump can be described as follows. The pump is driven by an external power source through shaft (1. A cylinder block 2 is connected to and rotates with the shaft. A series of pistons 3 in the cylinder block rotate with the block and rest at the right hand side against a tilted swash plate 4 which is located in the pump housing 5.

As the cylinder block rotates the pistons move back and forth in it with their displacement controlled by the angle of the swash disc 4 to the axis of the drive shaft 1. Valve orifices are located in a plate 6 to allow entry of fluid into the pump on the backstroke of the pistons and out of the pump on the forward stroke of the pistons. The inlet and outlet to the pump (not shown) are located in the end cap 7. At a fixed rotational speed and fixed swash plate angle the pump will deliver a constant flow of fluid at varying pressures. A pressure compensating valve generally designated 8 senses the hydraulic system pressure and as the pressure approaches the maximum operating pressure selected, opens conduit 9 to a flow of fluid under pressure. Conduit 9 is connected to cavities 10 and 11 through an opening generally designated 12 in a piston 13. The piston 13 is fixed in position in the end cap 7. A movable cylinder 14 slides over the piston and is in contact with the end of the swash plate 4. The introduction of fluid under pressure into conduits 9, 10, 11 and 12 by the action of the pressure compensating valve will exert a force on the cylinder 14 and when the pressure becomes high enough to overcome the force of spring 15 will move the swash plate to the neutral position and pumping will cease.

An adjustment screw 16 is connected through a rod 17 to contact the inner end of cylinder 14. Movement of the adjusting screw inwards will cause the rod 17 to limit the travel of cylinder 14 to the left and thereby limit the maximum swash plate angle and hence flow. The screw 16 therefore provides an independent control of the maximum output of the pump. The adjusting screw function is commonly incorporated into a hand wheel or lever control.

The theoretical operating characteristics of a pump of this type are generally described in FIG. 2. As the pressure increases to Pmax the maximum volume remains constant at Vmax and then abruptly drops to zero. The actual operating characteristics will vary slightly from theoretical with leakage and the sharpness of the cutoff of the compensator valve.

The horsepower required to deliver a volume of fluid at pressure is directly proportional to the flow times the pressure or $$HP = KVP$$

The horsepower required at mix flow will therefore vary linearly from 0 to a maximum value as the pressure increases as shown in FIG. 2.

A hydraulic system driving such a pump can only utilize the maximum horsepower of the power source at the maximum pressure and flow condition and will utilize considerable less than the maximum horsepower at lower pressures. In many applications it would be highly desirable if the maximum output flow could be increased as the pressure drops below Pmax so as to utilize a greater portion of the available horsepower over a portion of the operating range.

In FIG. 3 the dotted curve indicates the way in which the flow would vary for pressures below the maximum if the full horsepower of the source were utilized.

SUMMARY OF THE INVENTION

It is a principal purpose of this invention to provide a simple module which an be mounted on a standard production pressure compensated pump to provide improved horsepower utilization output over a portion of the pressure range.

It is a further purpose of this invention to provide a flow control as described which does not materially affect the operating characteristics of the pressure compensator on the pump.

Briefly, the present invention carries out the principals of the invention through provision of a swash plate control module which is incorporated as an integral part of a pressure compensated pump or which is in the form of a module which is adapted for installation on a conventional pressure compensated pump. The module incorporates a piston energized, spring biased plunger which is operated to control the maximum angle of the swash plate responsive to the pressure sensed at the discharge port of the pump. After a predetermined pressure has been reached as determined by precompression of the plunger retarding spring, the plunger will impart movement to the swash plate, reducing the stroke of the pistons in direct relation to output pressure.

Other and further features and advantages of the present invention will become apparent to one skilled in the art upon consideration of this entire disclosure. The form of the invention, which will now be described in detail, illustrates the general principals of the invention, but it is to be understood that this detailed description is not to be taken as limiting the scope of the present invention.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings, which drawings form a part of this specification.

It is to be noted, however, that the appended drawings illustrate only typical embodiments of this invention and are therefore not to be considered limiting of its scope, for the invention may admit to other equally effective embodiments.

In the Drawings:

FIG. 1 is a sectional view of a variable displacement pressure compensated pump which is representative of the prior art;

FIG. 2 is a graphical representation of the theoretical operating characteristics of variable displacement pressure compensated pumps such as shown in FIG. 1;

FIG. 3 is the graphical representation representing variation in flow of pumps such as that shown in FIG. 1 if full horsepower of the pump power source is utilized;

FIG. 4 is a sectional view illustrating a variable displacement pressure compensated pump constructed in accordance with the principals of the present invention;

FIG. 4A is a fragmentary sectional view of a modified embodiment of the invention illustrating a plunger piston having differing pressure responsive areas.

FIG. 5 is a graphical representation of the performance characteristic of the pressure compensated pump mechanism of FIG. 4;

FIG. 6 is a fragmentary sectional view of a pump mechanism similar to that of FIG. 4 which incorporates a pressure compensating module having dual plunger controlling springs;

FIG. 7 is a graphical representation illustrating the characteristics of a pressure compensated variable displacement pump incorporating the pressure compensating module of FIG. 6;

DETAILED DESCRIPTION OF PREFERRED EMBODIMENT

Figure 1:
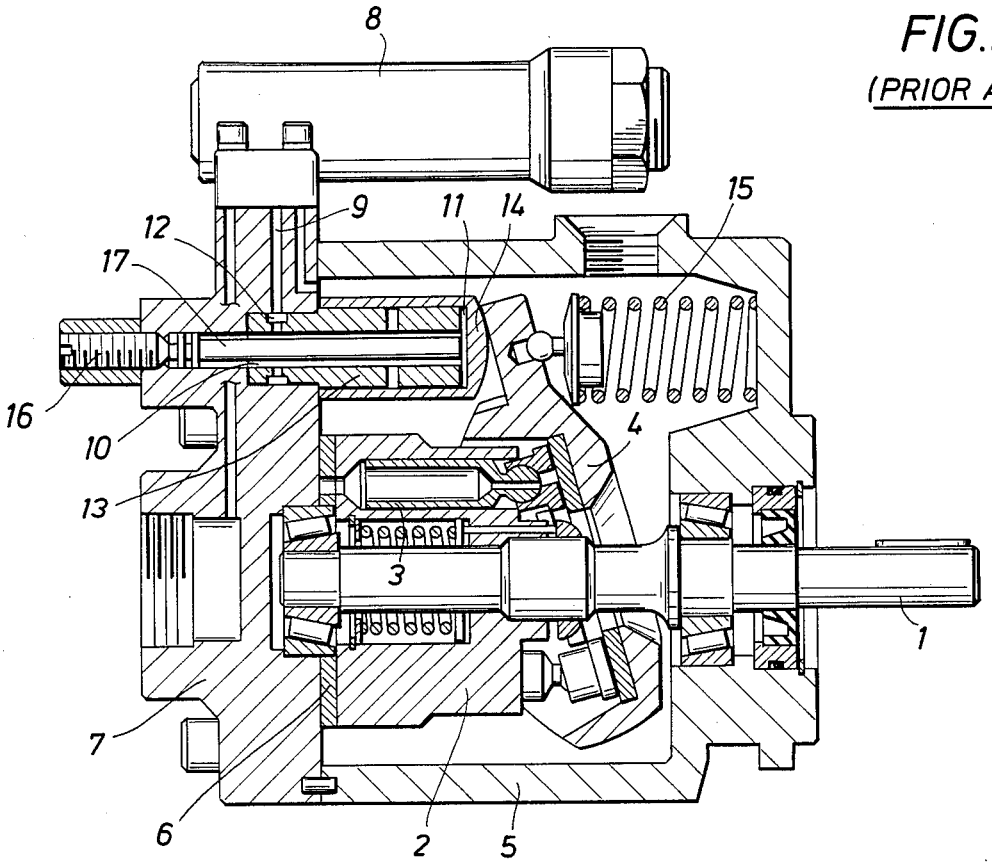
FIG.1 (PRIOR ART)
Figure 2:
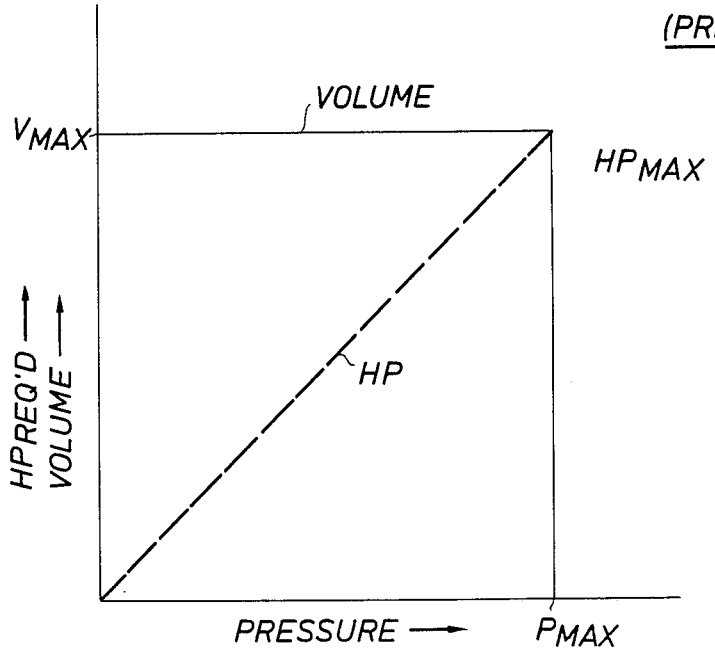
FIG.2 (PRIOR ART)

The invention relates to a simple method of improving the overall performance of a pressure compensated pumping system by automatically varying the maximum hydraulic fluid flow in inverse proportion to the operating pressure. Such a system would prove for much greater utilization of the available power over the operating range. One embodiment of the invention is shown in FIG. 4. From FIG. 4 it can be seen that an extension generally designated 18 has been added to the end plate 7' of the pump body. It will be obvious to one skilled in the art that such an extension would be added with little change to the structure of the pump. The cavity 19 in the extension 18 houses a spring 20 which will be generally precompressed during assembly. A plunger 21 contacts the spring on surface 22 and at the opposite end contacts the inside of the movable cylinder 14. A plug 23 is screwed into the end of extension 18 and forms a cylinder 24 in which rides a free floating piston 25 sealed in the cylinder by an o-ring 26. A conduit 27 to the left of piston 25 connects the cavity 28 to some point at the output of the hydraulic pump to sense the output pressure. The piston 25, at its right hand end, contacts the plunger 21.

The operation of the device can be described as follows. Under zero pressure the pump components will rest as shown in FIG. 4. When operating at maximum flow below the set pressure, the hydraulic system pressure acting on the left side of piston 25 will act against the combined force of spring 20 and spring 21. By proper selection of the precompression on spring 20 the piston 25 can be restrained from moving until a predetermined pressure level is reached. As the pressure is further increased the piston 25 will cause the spring 20 to compress and the plunger 21 will move to the right, pushing n cylinder 14', spring 21, and hence the swash plate 4 to reduce the maximum volumetric output of the pump. Correct selection of the spring rate of spring 20 will provide for the desired rate of change of maximum volume with pressure.

As the pressure level is increased the compensator valve will open to admit pressurized fluid into conduit 9' and hence inside cylinder 14'. If the diameter of piston 25 is smaller than that of the inside diameter of cylinder 14' the net effect of this pressure introduction will be to increase the loading on springs 20 and 21 and the swash plate will immediately be moved to the right and the fluid output decreased. This movement will occur as soon as pressure is sensed inside cylinder 14'. Under normal operation of a pressure compensated pump the pressure inside cylinder 14' must rise to a level sufficient to compress spring 21 before the flow reduction starts. The operation of the device with piston 25 smaller in area than cylinder 14 will result in considerable deterioration of the sharp pressure cutoff characteristics which are highly desirable in this type of pump.

If the diameter of piston 25 is made equal to that of cylinder 14' the introduction of pressure into cylinder 14' will increase the load on spring 20 by acting on the right hand face of cylinder 14' and attempting to compress spring 20. At the same time the fluid pressure will decrease the load on spring 20 by acting in the reverse direction on piston 25. If piston 25 and cylinder 14' are equal in area, the opposing forces will be equal and there will be no tendency for piston 25 to move to the right as the compensator valve first opens and admits pressure into cylinder 14'.

When the pressure in cylinder 14' reaches a sufficient level to compress spring 21 then normal unloading will take place with no adverse effect from the presence of the maximum volume control assembly.

The use of a piston 25 equal in diameter to that of cylinder 14' can result in very high forces on spring 20 by virtue of the full discharge pressure acting in cavity 28. The spring forces required can be substantially reduced using a stepped piston as shown in FIG. 4A.

The forward part 25' of the piston in FIG. 4A is of the same size as cylinder 14' and hence will provide the advantages described above. The opposite end of the piston 31 is reduced in diameter and extends through bore 29 to the atmosphere. An O-ring 30, seals the piston extension 31 in bore 29 and conduit 27' connects the discharge pressure to cavity 3. In this configuration the discharge pressure acts only on an area equal to the difference between the cross sectional area of the right hand portion (25') of the piston and cross sectional area of the piston extension 31. The loading on spring 20' can thereby be significantly reduced without affecting the performance of the device.

Figure 5:
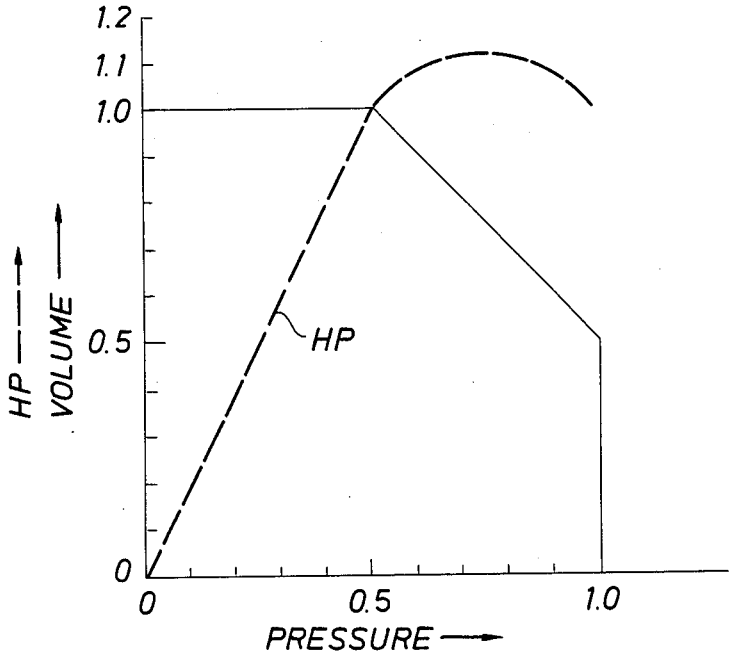

The performance characteristics of a pressure compensated pump with the improvements shown can be seen in FIG. 5. For purposes of explanation it will be assumed that the precompression of spring 20 is adjusted so that volumetric control will start at 50% of the maximum pressure and the spring rate is set so that the volumetric flow is reduced in half between one half and full pressure. It is further assumed that the variation of volume with pressure is linear.

It can be seen from FIG. 5 that the invention provides control of volume inversely proportional to pressure over ½ the operating range. The horsepower requirements shown in the dotted line vary only 12% over a 50% change in pressure and volume.

Figure 6:
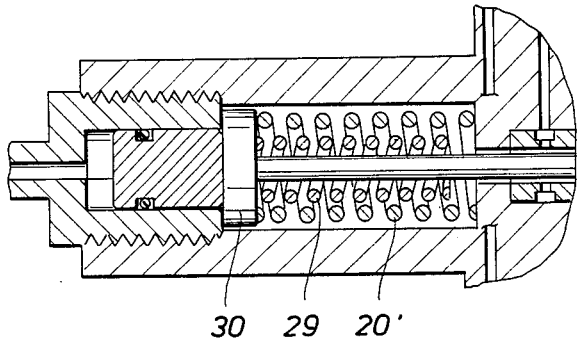
Figure 7:
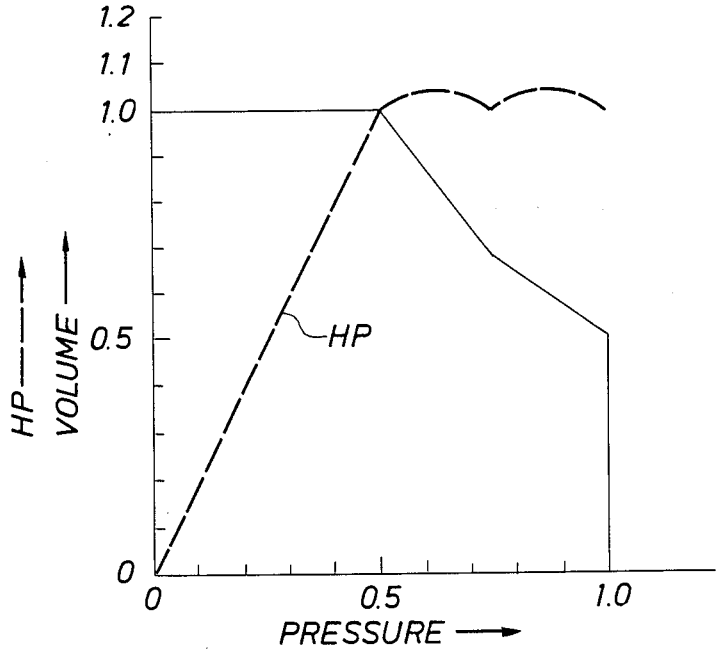

An improvement in the invention can result if a nonlinear spring or combination of springs is used in place of spring 20 in FIG. 4. One such configuration is shown in FIG. 6 spring 20' is precompressed so as to start movement at 50% of maximum pressure. The spring rate of spring 20 is selected to prove a 33% reduction in flow at 75% of maximum pressure. Spring 29, inside spring 20 is shorter than spring 20 and is not contacted by the head 30 until spring 20 is compressed to its position at 75% of maximum pressure. The spring constant of spring 29 is set so that the combination of springs 20' and 29 give a flow variation of from 67% to 50% between 75% and 100% of maximum pressure. The characteristics of this pump are shown graphically in FIG. 7. In this configuration flow versus pressure characteristics between 50% and full pressure more closely approximate the theoretically required hyperbolic relationship and the horsepower variation over a 50% change in pressure and volume is less than 5%. This is a significant improvement over the characteristics of FIG. 5 with very little additional mechanical complexity.

It will be obvious to one skilled in the art and familiar with commercially available pressure compensated axial piston pumps that the proposed invention can be incorporated with little change to the structure of the hydraulic pump. It will also be found that the selection of springs to provide the required control can be easily determined.

In view of the foregoing, it is respectfully submitted that a constant power variable volume pump mechanism has been provided herewith which accomplishes all of the features and objects hereinabove set forth together with other features which are inherent in the valve mechanism itself. It will be understood that certain combinations and subcombinations of this invention are of utility and may be employed without reference to other features and subcombinations. This is contemplated by and is within the scope of the present invention.

What is claimed is:

1. In a variable volume pressure compensated rotary pump having a housing containing a multiple piston type pumping assembly, a swash plate for controlling the displacement of said multiple piston pumping assembly, a first spring means urging said swash plate to its maximum travel and hence maximum flow position, a swash plate controlling piston engaging said swash plate and forming a pressure responsive area, said swash plate controlling piston being movable to urge said swash plate towards its minimum travel and zero flow position in response to compensator pressure from a compensator valve acting on said pressure responsive area, the improvement comprising:

(a) a plunger movably supported by said housing and capable of engaging said swash plate controlling piston;

(b) second spring means urging said plunger in a direction away from said swash plate controlling piston;

(c) second piston means being operative to move said plunger towards said swash plate controlling piston for limiting the maximum travel of said swash plate, said second piston means forming a second pressure responsive area exposed to said compensator pressure and being substantially equal to said pressure responsive area of said swash plate controlling piston;

(d) means communicating discharge pressure from said pump to said second piston means; and (e) means communicating said compensator pressure to act on said second piston means in opposition to said discharge pressure.

2. The improvement of claim 1, wherein said second piston means forms a pressure responsive area exposed to said compensator pressure and being substantially equal to said pressure responsive area of said swash plate controlling piston, said second piston means also forming a second pressure responsive area of smaller dimension than said pressure responsive area opposite to and and being exposed to said discharge pressure.

3. The improvement of claim 1, wherein:

(a) a plunger cavity is defined by said housing and is in communication with said swash plate controlling piston; and (b) said plunger is movably disposed within said plunger cavity and has one end thereof capable of engagement with said swash plate controlling piston.

4. The improvement of claim 3, wherein:

(a) a piston cavity is formed by said housing;

(b) said second piston means is movably positioned within said piston cavity; and (c) said means continuously communicating discharge pressure to said second piston means comprises conduit means communicating said piston cavity with pump discharge pressure.

5. The improvement of claim 1, including:

(a) a hollow extension extending from said housing and forming a plunger cavity and a piston cavity;

(b) an elongated plunger being movably disposed within said plunger cavity and having a section thereof extending into said housing and capable of engaging said swash plate controlling piston and controlling maximum travel of said swash plate;

(c) compression spring means disposed within said plunger cavity and forming said second spring urging means, said compression spring means having respective ends engaging said plunger and said housing and establishing a predetermined pressure level for initiation of plunger movement;

(d) conduit means communicating discharge pressure of said pump to said piston cavity; and (e) said second piston means being disposed within said piston cavity and being responsive to said discharge pressure to impart movement to said plunger against the combined force of at least said second spring means and swash plate controlling said compensator pressure on said second pressure responsive area.

6. The improvement of claim 5, wherein said second compression spring means comprises a primary compression spring in continuous force transmitting engagement with said plunger and housing and a secondary compression spring being in force transmitting engagement with said plunger and housing only after predetermined movement of said plunger toward said swash plate controlling piston.

7. In a variable volume pressure compensated rotary pump having a housing containing a multiple piston type pumping assembly, a swash plate for controlling the displacement of said multiple piston pumping assembly, a first spring means urging said swash plate to its maximum travel, and hence maximum flow position, a swash plate controlling piston engaging said swash plate and forming a pressure responsive area, said swash plate controlling piston being movable to urge said swash plate towards its minimum travel and zero flow position in response to compensator pressure from a compensator valve acting on said pressure responsive area, the improvement comprising:

(a) a piston cavity formed in said housing;

(b) second piston means being movably disposed in said piston cavity and being capable of force imparting engagement with said piston said second piston means forming a second pressure responsive area substantially equal to said pressure responsive area;

(c) second spring means being in force transmitting engagement with said second piston means, said second spring means urging said second piston means away from said swash plate controlling piston;

(d) means communicating discharge pressure of said pump to said piston cavity, said discharge pressure urging said second piston means towards said swash plate controlling piston; and (e) means communicating said compensator pressure to said piston cavity, said compensator pressure acting on said second pressure responsive area of said second piston means in opposition to said discharge pressure.

8. The improvement of claim 7, wherein:

said second piston means also forms a third pressure responsive area of smaller dimension than said pressure responsive area and being exposed to said discharge pressure.

9. The improvement of claim 7 wherein conduit means communicates said piston cavity with discharge pressure.

10. The improvement of claim 7, including a plunger means intermediate said second piston means and said swash plate controlling piston to transmit discharge pressure induced force from said second piston means to said swash plate controlling piston.

11. The improvement of claim 10, wherein said second spring means establishes a predetermined force restraining discharge pressure induced movement of said second piston means until a predetermined pump discharge pressure is reached.

12. The improvement of claim 11 wherein said second spring means comprises a primary compression spring in continuous force transmitting engagement with said second piston and a secondary compression spring being in force transmitting engagement with said second piston only after predetermined movement of said second piston towards said swash plate controlling piston.

13. The improvement as recited in claim 7 including:

(a) second piston means being movable relative to said housing and capable of engaging said swash plate controlling piston, said second piston means moving in response to the discharge pressure from said pump and said compenstor pressure acting on said second piston means in opposition to said discharge pressure thus causing movement of said swash plate controlling piston so as to limit the maximum swash plate travel in inverse proportion to the discharge pressure of said pump over a portion of the operating range thereof; and (b) means restraining movement of said second piston means until a predetermined pump discharge pressure has been reached.

14. The improvement of claim 13, wherein said restraining means comprises compression spring means urging said second piston means in a direction away from said swash plate controlling piston.

15. The improvement of claim 14, including:

(a) means forming a piston chamber in communication with pressure acting on said pressure responsive area;

(b) said second piston means forming a movable sealed partition within said piston chamber and being exposed on one side to said pressure acting on said pressure responsive area; and (c) means communicating discharge pressure of said pump to said piston chamber on the opposite side of said second piston means, whereby discharge pressure and pressure acting on said pressure responsive area act simultaneously and in opposed relation on said second piston means and develop a pressure differential to which said second piston means is movably responsive.

* * * * *